US006651836B1

(12) United States Patent
Hofheins et al.

(10) Patent No.: US 6,651,836 B1
(45) Date of Patent: Nov. 25, 2003

(54) HAND-HELD PLATE FOR HOLDING A BEVERAGE CONTAINER AND FOOD

(76) Inventors: Leonard L. Hofheins, 930 Detroit Ave., Suite E, Concord, CA (US) 94518; Del M. Thornock, 930 Detroit Ave., Suite E, Concord, CA (US) 94518

( * ) Notice: Subject to any disclaimer, the term of this patent is extended or adjusted under 35 U.S.C. 154(b) by 0 days.

(21) Appl. No.: 10/189,872

(22) Filed: Jul. 3, 2002

(51) Int. Cl.[7] ..... A47G 19/06

(52) U.S. Cl. ..... 220/575; 206/562; 220/23.83; 220/737; 229/904

(58) Field of Search ..... 220/23.8, 23.83, 220/23.4, 737, 738, 556, 574, 575; 229/904, 407; 206/562, 563, 565, 217, 541; 294/172, 146

(56) References Cited

U.S. PATENT DOCUMENTS 2,314,935 A * 3/1943 Gutterman ..... 206/563
2,766,919 A * 10/1956 Randall ..... 294/144
2,826,346 A * 3/1958 Randall ..... 229/406
3,381,825 A * 5/1968 Bessett ..... 211/74
4,218,008 A * 8/1980 Veilleux ..... 229/406
4,219,144 A * 8/1980 Hagelberg ..... 229/406
4,381,847 A * 5/1983 Bessett et al. ..... 229/406
5,184,750 A * 2/1993 Moller ..... 220/575
5,657,506 A * 8/1997 Pankow ..... 15/104.92
5,695,052 A * 12/1997 Damato ..... 206/217
5,947,011 A * 9/1999 Xu ..... 99/357
6,315,151 B1 * 11/2001 Hupp et al. ..... 220/666
6,398,056 B1 * 6/2002 Letourneau et al. ..... 220/23.8

* cited by examiner

*Primary Examiner*—Lee Young
*Assistant Examiner*—Joseph C. Merek
(74) *Attorney, Agent, or Firm*—Thomas R. Lampe

(57) ABSTRACT

A hand-held plate for holding a beverage container and food includes flexible flaps which frictionally engage the outer peripheral surface of a beverage container to maintain the beverage container in stable condition relative to the plate.

10 Claims, 6 Drawing Sheets

HAND-HELD PLATE FOR HOLDING A BEVERAGE CONTAINER AND FOOD

TECHNICAL FIELD

This invention relates to a plate to be held by an individual and more particularly to a molded plate of integral construction for holding a beverage container and food in a highly stable manner.

BACKGROUND OF THE INVENTION

Hand-held plates for carrying foods, beverage containers and accessories such as utensils are well known generally. The following U.S. patents disclose plates of this nature: U.S. Pat. No. 5,607,077, issued Mar. 4, 1997, U.S. Pat. No. 5,429,057, issued Jul. 4, 1995, U.S. Pat. No. 5,950,856, issued Sep. 14, 1999, U.S. Pat. No. 5,259,528, issued Nov. 9, 1993, U.S. Design Pat. No. D206,390, issued Dec. 6, 1966, U.S. Pat. No. 5,429,266, issued Jul. 4, 1995, U.S. Pat. No. 3,656,681, issued Apr. 18, 1972, U.S. Pat. No. 5,421,459, issued Jun. 6, 1995, and U.S. Pat. No. 5,170,908, issued Dec. 15, 1992.

As will be seen below, the invention disclosed and claimed herein incorporates a number of features contributing to the utility of the invention, including the use of flexible beverage container engagement flaps for holding a beverage container in a highly stable manner. The invention is characterized by its strength, stability and ease of use. The invention can readily accommodate different types, sizes and shapes of beverage containers.

DISCLOSURE OF INVENTION

The present invention relates to a hand-held plate for holding a beverage container and food. The plate is of integral, molded construction and includes an outer rim portion.

The plate also includes a food receptacle portion disposed inwardly of the outer rim portion and defined by a food receptacle side wall and a food receptacle bottom wall.

The plate also includes a beverage container holder portion disposed inwardly of the outer rim portion and adjacent to the food receptacle portion.

The beverage container holder portion includes a generally planar wall extending between the outer rim portion and the food receptacle side wall. The generally planar wall is disposed at a higher elevation than the food receptacle bottom wall and defines an opening for accommodating a beverage container.

The beverage container holder portion additionally includes a plurality of flexible beverage container engagement flaps integral with the generally planar wall and extending into the opening. The flexible beverage container engagement flaps have upper flap surfaces and are deformable when initially engaged by a beverage container to flex downwardly and frictionally engage an outer peripheral surface of the beverage container with the upper flap surfaces.

The flexible flaps are maintained in sufficient frictional engagement with the beverage container to maintain the beverage container at a fixed location in the opening in a stable manner.

Other features, advantages and objects of the present invention will become apparent with reference to the following description and accompanying drawings.

MODES FOR CARRYING OUT THE INVENTION

Figure 1:
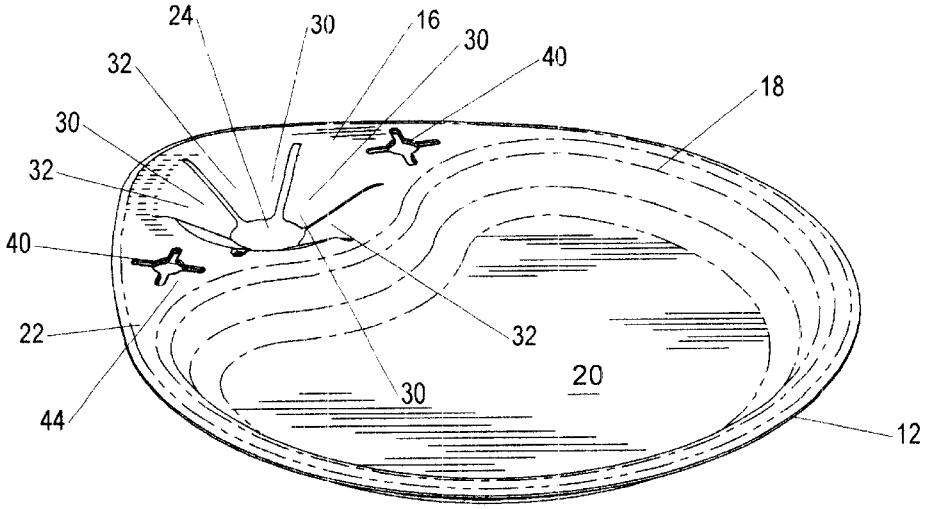
FIG. 1 is a top, perspective view of a preferred embodiment of plate constructed in accordance with the teachings of the present invention.

Referring now to FIGS. 1–4, an embodiment of a hand-held plate constructed in accordance with the teachings of the present invention is illustrated. The plate is of molded, integral construction and may be made of any suitable material such as paperboard or plastic molded to the desired shape. The plate is for holding a beverage container, such as beverage can 10 shown in FIGS. 2 and 3 and food (not shown).

The plate includes an outer rim portion 12, a food receptacle portion 14 disposed inwardly of the outer rim portion and a beverage container holder portion 16, also disposed inwardly of the outer rim portion.

The food receptacle portion 14 is defined by a food receptacle side wall 18 and a food receptacle bottom wall 20.

The beverage container holder portion 16 is disposed adjacent to the food receptacle portion. The beverage container holder portion includes a generally planar wall 22 extending between the outer rim portion and the food receptacle side wall. The wall 22 is disposed at a higher elevation than the food receptacle bottom wall and defines an opening 24 for accommodating a beverage container, such as beverage can 10.

The beverage container holder portion additionally includes a plurality of flexible beverage container engagement flaps 30 integral with the wall 22 and extending into the opening 24.

Figure 2:
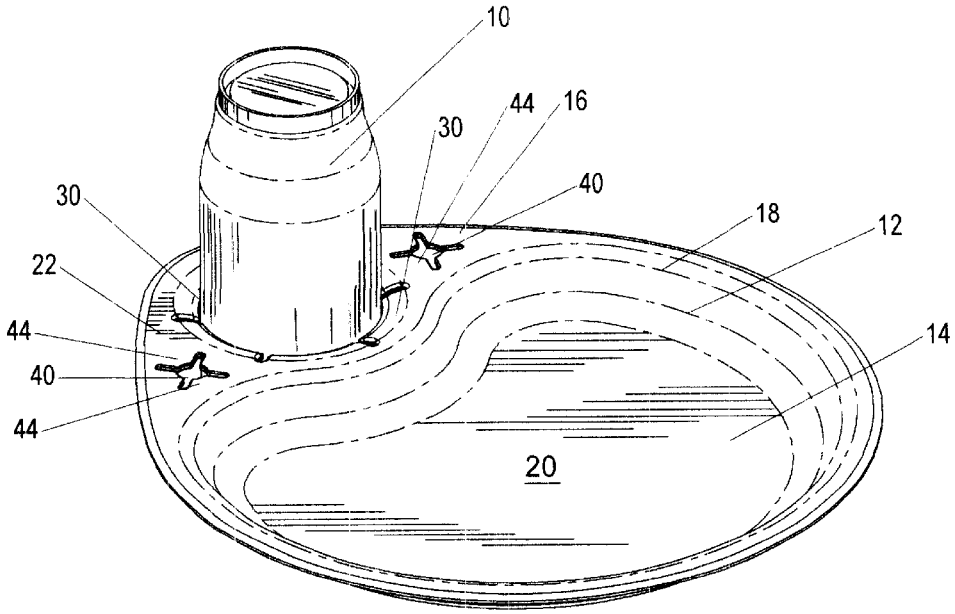
FIG. 2 is a view similar to FIG. 1, but illustrating a beverage can being held by the plate.
Figure 3:
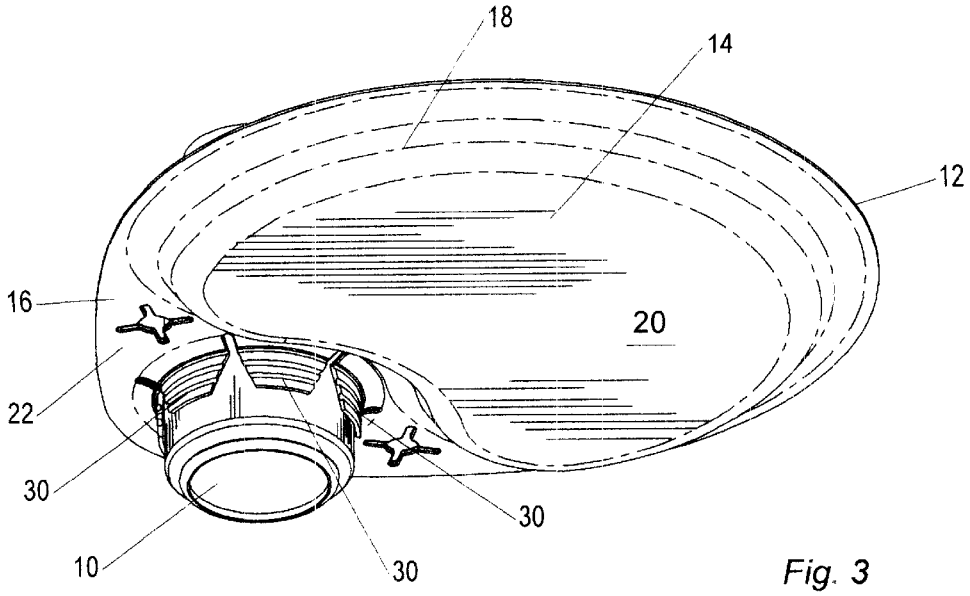
FIG. 3 is a bottom, perspective view of the plate showing the beverage can projecting downwardly therefrom.
Figure 4:
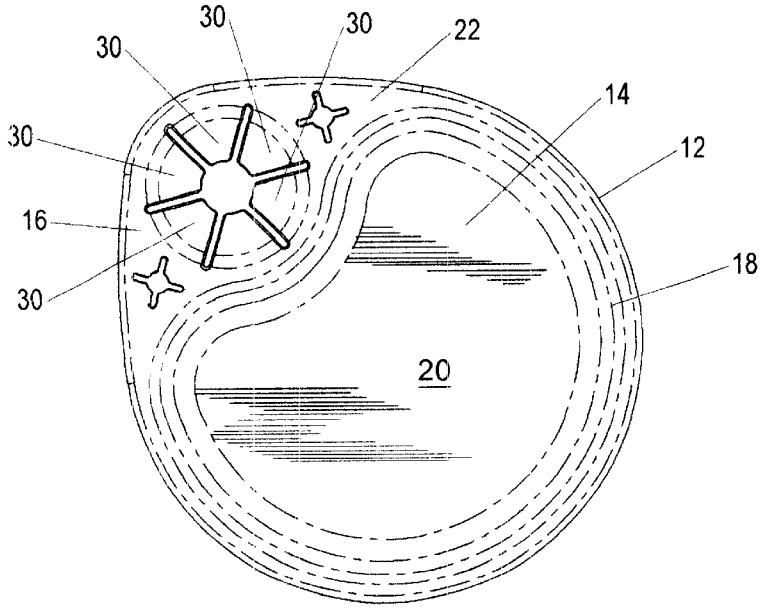
FIG. 4 is a top, plan view of the plate.

The flexible beverage container engagement flaps 30 have upper flap surfaces 32 and the flaps are deformable when initially engaged by a beverage container to flex downwardly and frictionally engage an outer peripheral surface of the beverage container with the upper flap surfaces. This is shown in FIGS. 2 and 4.

The flexible beverage container engagement flaps have an elastic memory whereby the flaps are continuously urged toward the beverage container and maintained in frictional engagement with the beverage container to maintain the container in a fixed position in the opening 24 in a highly stable manner. Flaps 30 are separated by slits or slots as shown and flex or bend independently, enabling beverage containers of different sizes and shapes to be held by the plate.

The flaps have free distal ends and converge toward the center of the opening 24. As may perhaps best be seen with reference to FIG. 1, the flaps, even when not accommodating a container, project downwardly in some degree from the wall 22. The upper flap surfaces are convexly downwardly curved immediately adjacent to the wall 22 for guiding the beverage container toward the center of the opening when the beverage container is being placed in the opening.

The food receptacle side wall has a curved food receptacle side wall section 38 adjacent to opening 24 and spaced from the opening. The section 38 is substantially parallel to the outer periphery of the closest segment of the opening. It has been found that such an arrangement not only effectively utilizes the space of the plate but also adds to the stability of the plate at the juncture between the beverage container holder portion and the food receptacle portion.

Generally planar wall 22 defines holes 40 for receiving utensils, such as knives, forks and spoons or napkins. The holes 40 are spaced from opening 24. Flexible holder fingers 44 are formed by the beverage container holder portion and project into the holes. It will be appreciated that when utensils, napkins and the like are inserted into holes 40, the flexible holder fingers will deflect downwardly and bear against those articles to retain them in place due to frictional engagement.

Figure 5:
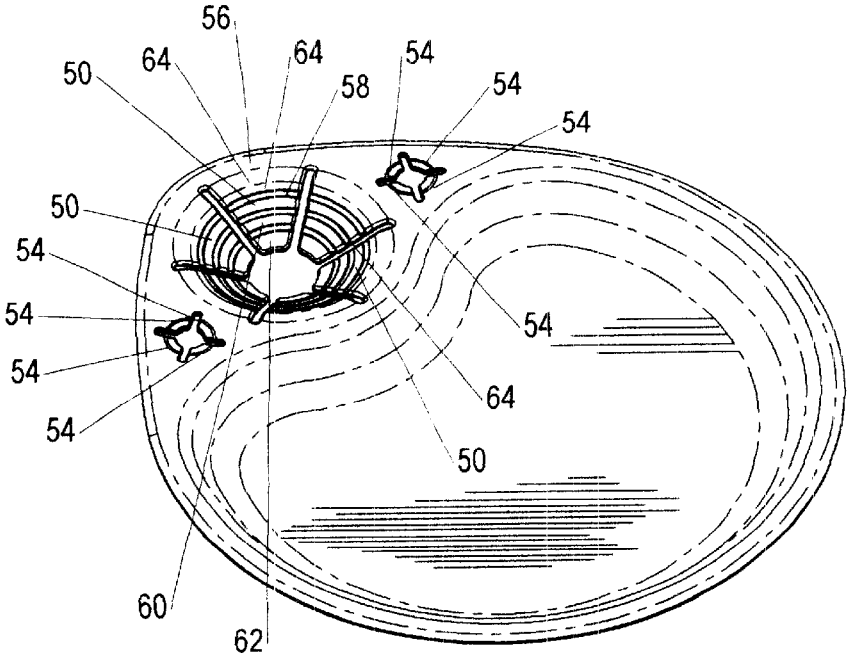
FIG. 5 is a top, perspective view of an alternative embodiment of the plate of this invention.
Figure 6:
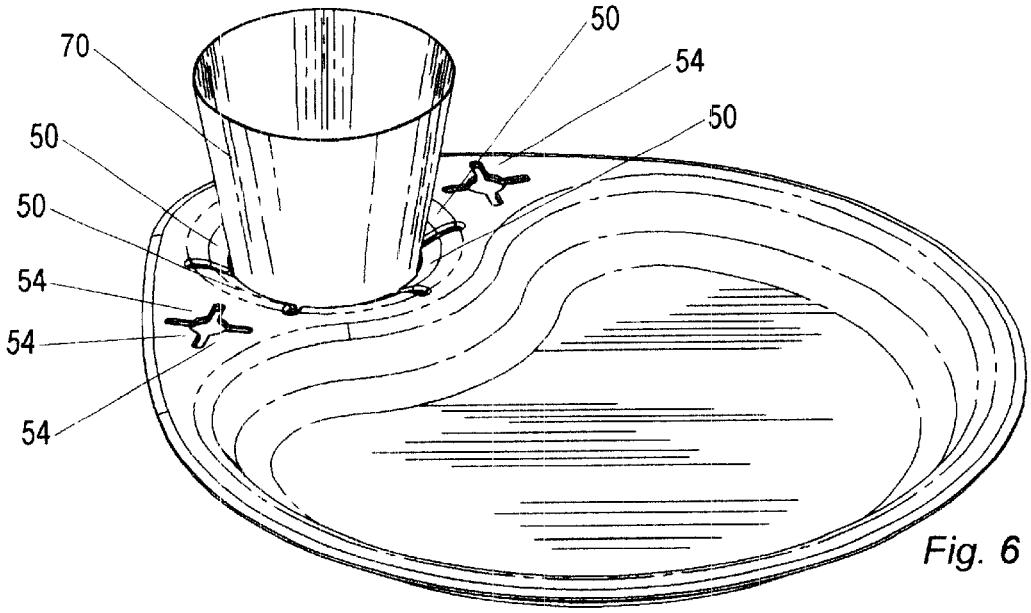
FIG. 6 is a view similar to FIG. 5, but illustrating a container in the form of a beverage cup being held by the plate.
Figure 7:
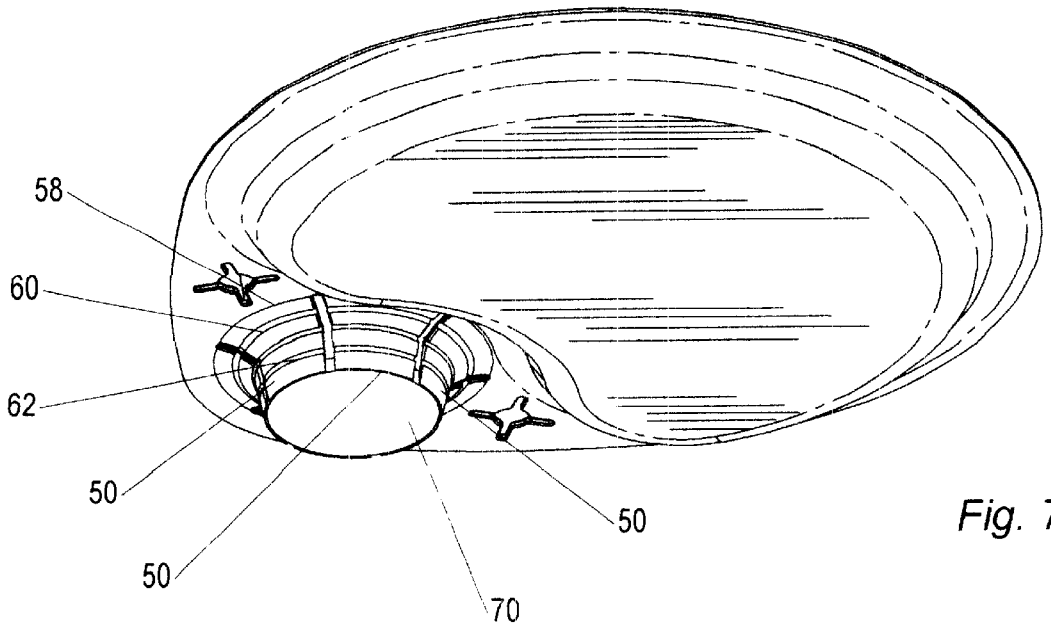
FIG. 7 is a bottom, perspective view of the plate of FIGS. 5 and 6, illustrating a cup projecting downwardly therefrom.

FIGS. 5–7 illustrate an alternative embodiment of the invention which is the same in all respects as the embodiment of FIGS. 1 and 4 except that flaps 50 are of different construction than above-described flaps 30 and that flexible holder fingers 54 are of different construction than flexible holder fingers 44 described above. More particularly, with respect to the flaps, each flap 50 comprises a plurality of flap segments 56, 58, 60 and 62 interconnected by and relatively pivotally movable about hinges comprising parallel hinge lines 64 of reduced thickness formed in the top of the generally triangular-shaped flaps. The hinge lines are perpendicular to the primary axes of the flaps. This arrangement facilitates conformation of the flaps to the shape of the outer surface of the beverage container to readily adapt to different types, sizes and shapes of the container, such as cup 70.

Figure 8:
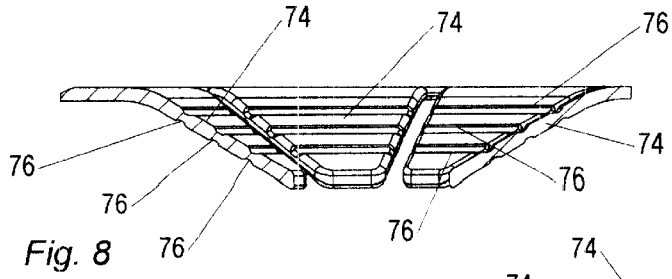
FIG. 8 is an enlarged, sectional view illustrating portions of the flexible beverage container engagement flaps of the plate of FIG. 5.
Figure 9:
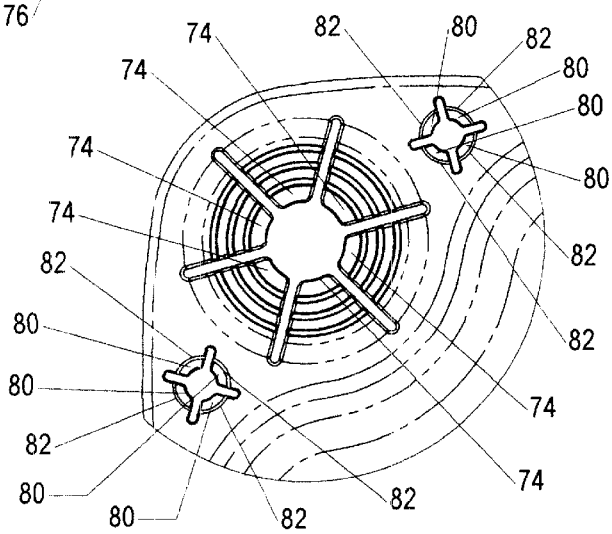
FIG. 9 is a top, plan view of a selected segment of the plate of FIG. 5 and illustrating all of the flexible beverage container engagement flaps thereof as well as two utensil holders incorporated in the plate.

FIGS. 8 and 9 illustrate another form of flap which might be utilized, these flaps being identified by reference numeral 74. In this arrangement the flap segments of the flaps are interconnected by and relatively pivotally movable about hinges formed by parallel hinge lines 76 of reduced thickness formed in both the tops and bottoms of the flaps between the free distal ends of the flaps and the upper, connected ends of the flaps.

As can be seen in FIG. 9, in this arrangement the flexible holder fingers 80 have curved hinge lines of reduced thickness 82 formed therein to promote accommodation of different sized utensils, napkins, etc.

Figure 10:
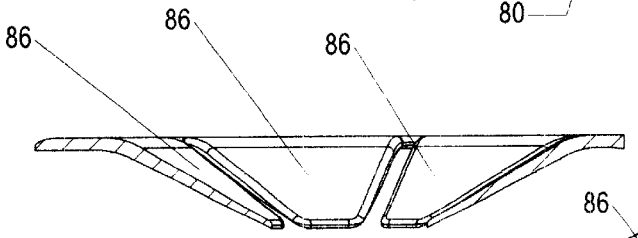
FIG. 10 is a view similar to FIG. 8, but illustrating an alternate embodiment of flexible beverage container engagement flaps.
Figure 11:
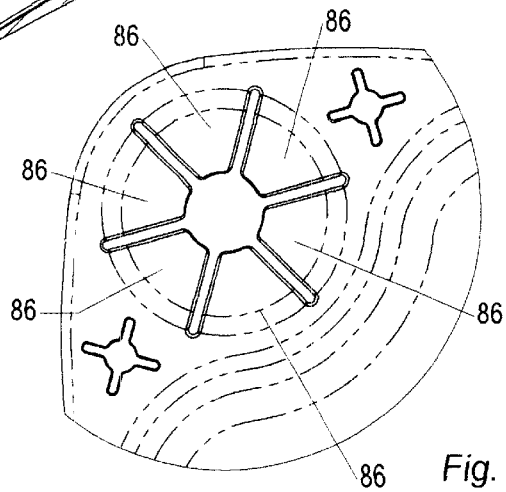
FIG. 11 is a view similar to FIG. 9, but illustrating the flexible beverage container engagement flaps of FIG. 10.

Another flexible beverage container engagement flap construction is shown in FIGS. 10 and 11. In this arrangement, the generally triangular-shaped flaps 86 vary in thickness, diminishing in thickness and increasing in flexibility in the direction of the distal ends thereof.

Figure 12:
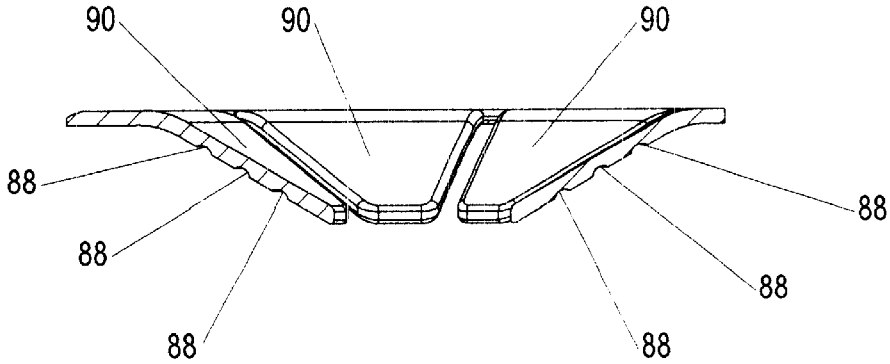
FIG. 12 is a view similar to FIGS. 8 and 10, but illustrating yet another form of flexible beverage container engagement flaps.
Figure 13:
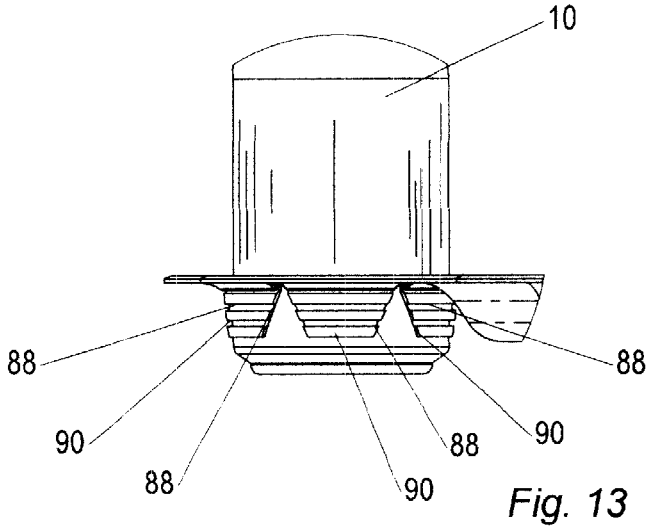
FIG. 13 is a broken away, side, elevational view illustrating the flaps of FIG. 12 engaging and holding a can.

FIGS. 12 and 13 disclose yet another flap construction wherein hinge lines of reduced thickness 88 are formed at the bottom of flaps 90. FIG. 13 shows flaps 86 holding a beverage can 10.

The invention claimed is:

1. A hand-held plate for holding a beverage container and food, said plate being of integral, molded construction and including:

an outer rim portion;

a food receptacle portion disposed inwardly of said outer rim portion and defined by a food receptacle side wall and a food receptacle bottom wall; and a beverage container holder portion disposed inwardly of said outer rim portion adjacent to said food receptacle portion, said beverage container holder portion including a top wall extending between said outer rim portion and said food receptacle side wall disposed at a higher elevation than said food receptacle bottom wall and defining an opening for accommodating a beverage container, said beverage container holder portion additionally including a plurality of flexible beverage container engagement flaps integral with said top wall, projecting downwardly therefrom and extending into said opening, said flexible beverage container engagement flaps having upper flap surfaces which are convexly downwardly curved immediately adjacent to the top wall for guiding a beverage container toward said opening when engaged by said beverage container and being deformable when initially engaged by said beverage container to flex downwardly and frictionally engage an outer peripheral surface of said beverage container with said upper flap surfaces, frictional engagement between said flexible beverage container engagement flaps and said beverage container maintaining said beverage container at a fixed location in said opening in a stable manner, at least one of said flexible beverage container flaps having a distal flap end, a plurality of spaced, substantially parallel hinges extending thereacross spaced from said top wall and located between said top wall and said distal flap end thereof, and being comprised of a plurality of flap segments interconnected by and relatively pivotally movable about said hinges.

2. The hand-held plate according to claim 1 wherein each of said hinges comprises a hinge line of reduced thickness formed in said at least one flexible beverage container engagement flap.

3. The hand-held plate according to claim 2 wherein each of said hinge lines is substantially perpendicular to a primary axis of said at least one flexible beverage container engagement flap.

4. The hand-held plate according to claim 1 wherein said food receptacle side wall has a curved food receptacle side wall section adjacent to said opening and spaced from said opening, the curved food receptacle side wall section being substantially parallel to a segment of the outer periphery of said opening.

5. The hand-held plate according to claim 2 wherein at least one of said hinge lines is formed in a top surface of said at least one flexible beverage container engagement flap.

6. The hand-held plate according to claim 2 wherein at least one of said hinge lines is formed on a bottom surface of said at least one flexible beverage container engagement flap.

7. The hand-held plate according to claim 1 wherein said flexible beverage container engagement flaps have an elastic memory continuously urging said flexible beverage container flaps toward said beverage container.

8. The hand-held plate according to claim 1 wholly formed from paperboard.

9. The hand-held plate according to claim 1 wholly formed from plastic material.

10. A hand-held plate for holding a beverage container and food, said plate being of integral, molded construction and including:

an outer rim portion;

a food receptacle portion disposed inwardly of said outer rim portion and defined by a food receptacle side wall and a food receptacle bottom wall; and a beverage container holder portion disposed inwardly of said outer rim portion adjacent to said food receptacle portion, said beverage container holder portion including a top wall extending between said outer rim portion and said food receptacle side wall disposed at a higher elevation than said food receptacle bottom wall and defining an opening for accommodating a beverage container, said beverage container holder portion additionally including a plurality of flexible beverage container engagement flaps integral with said top wall and extending downwardly from said top wall into said opening, said flexible beverage container engagement flaps having upper flap surfaces and being deformable when initially engaged by a beverage container to flex downwardly and frictionally engage an outer peripheral surface of said beverage container with said upper flap surfaces, frictional engagement between said flexible beverage container engagement flaps and said beverage container maintaining said beverage container at a fixed location in said opening in a stable manner, at least one of said flexible beverage container flaps being comprised of a plurality of flap segments interconnected by and relatively pivotally movable about a plurality of hinges, said hinges being spaced from one another and spaced downwardly from said top wall.

* * * * *